US011858600B2

(12) United States Patent
West et al.

(10) Patent No.: US 11,858,600 B2
(45) Date of Patent: Jan. 2, 2024

(54) LEASH ASSEMBLY FOR A SPORTS BOARD

(71) Applicant: Dakine IP Holdings LP, New York, NY (US)

(72) Inventors: Zachary West, Seattle, WA (US); John Martin, Vashon, WA (US); Brian Fletcher, Issaquah, WA (US); Mirona Motoc, Seattle, WA (US); Jay Willet, Tacoma, WA (US); Aaron Ambuske, Seattle, WA (US)

(73) Assignee: Dakine IP Holdings LP, New York, NY (US)

( * ) Notice: Subject to any disclaimer, the term of this patent is extended or adjusted under 35 U.S.C. 154(b) by 0 days.

(21) Appl. No.: 17/694,505

(22) Filed: Mar. 14, 2022

(65) Prior Publication Data

US 2022/0274675 A1 Sep. 1, 2022

Related U.S. Application Data

(63) Continuation of application No. 16/802,498, filed on Feb. 26, 2020, now Pat. No. 11,273,888.

(60) Provisional application No. 62/810,890, filed on Feb. 26, 2019.

(51) Int. Cl.
*B63B 34/60* (2020.01)

(52) U.S. Cl.
CPC ..... *B63B 34/60* (2020.02)

(58) Field of Classification Search
CPC ..... B63B 34/60; B63B 32/70
See application file for complete search history.

(56) References Cited

U.S. PATENT DOCUMENTS 4,041,562 A * 8/1977 Nealy ..... B63B 32/77 441/75
4,044,415 A 8/1977 Wood
4,234,990 A * 11/1980 Colburn ..... B63B 32/70 441/75
4,265,448 A 5/1981 Anderson, Jr.
(Continued)

FOREIGN PATENT DOCUMENTS

JP 09-76990 A 3/1997
WO 2017139840 A1 8/2017
WO 2017181225 A1 10/2017

OTHER PUBLICATIONS

Quality Surfboards Hawaii, "Introducing the Kaimana", Online, Mar. 6, 2020, Retrieved from the Internet on Apr. 30, 2020, https://www.youtube.com/watch?time_con, tinue=1&v=b8hyBMrg-eM&feature=emb_logo, 1 page.
(Continued)

*Primary Examiner* — S. Joseph Morano
*Assistant Examiner* — Jovon E Hayes
(74) *Attorney, Agent, or Firm* — Kolisch Hartwell, P.C.

(57) ABSTRACT

Cuff assemblies for sports board leashes, where the cuff assembly includes a central section that having a precurved molded insert that is configured to connect to a cord of the sports board leash, a first wing attached to a first side of the central section, and a second wing attached to a second side of the central section. The maximum width of the central section of the cuff assembly is greater than the maximum width of either of the first wing or second wing, and the first wing and second wing are configured to overlap and fasten to each other in order to secure the cuff assembly around a person's limb portion.

18 Claims, 10 Drawing Sheets

(56) References Cited

U.S. PATENT DOCUMENTS

| | | | | |
|---|---|---|---|---|
| D279,023 | S | 5/1985 | Wessels | |
| 4,610,634 | A * | 9/1986 | Kimura | B63B 32/70 441/75 |
| D303,278 | S | 9/1989 | Nealy | |
| 5,643,028 | A * | 7/1997 | Craig | B63B 32/73 24/115 F |
| 5,775,965 | A * | 7/1998 | Hango | B63B 32/70 441/74 |
| 5,957,741 | A * | 9/1999 | Evans | B63B 32/73 441/75 |
| 6,000,979 | A * | 12/1999 | Stewart | B63B 32/22 441/75 |
| 6,471,560 | B2 | 10/2002 | Kerckhoff | |
| 6,500,039 | B1 * | 12/2002 | Underwood | B63B 32/73 119/770 |
| 7,412,944 | B2 * | 8/2008 | Wescombe-Down | A01K 79/02 119/908 |
| 7,918,699 | B2 * | 4/2011 | Malloy | B63B 32/77 441/75 |
| D677,354 | S | 3/2013 | Nolan et al. | |
| 8,834,221 | B2 | 9/2014 | Cregan | |
| 8,894,457 | B1 * | 11/2014 | Crozier | B63B 32/70 441/75 |
| D736,331 | S * | 8/2015 | Martinson | D21/774 |
| 9,248,891 | B2 | 2/2016 | Falken | |
| 9,456,826 | B2 * | 10/2016 | Henderson | B63C 9/00 |
| 9,580,154 | B2 * | 2/2017 | Falken | B63B 32/73 |
| 10,066,786 | B1 * | 9/2018 | Cox | F16M 11/2085 |
| 10,081,415 | B1 * | 9/2018 | Sun | B63C 11/04 |
| D857,825 | S | 8/2019 | Pang | |
| 10,737,750 | B2 * | 8/2020 | Lundstedt, Jr. | B63B 32/73 |
| 2006/0014450 | A1 | 1/2006 | Crumrine | |
| 2008/0098965 | A1 * | 5/2008 | Hachigian | A01K 27/001 119/792 |
| 2010/0133306 | A1 * | 6/2010 | Monroe | B63B 32/73 224/267 |
| 2012/0244763 | A1 | 9/2012 | Cregan | |
| 2013/0130579 | A1 * | 5/2013 | Nolan | B63B 32/73 29/446 |
| 2014/0127957 | A1 * | 5/2014 | Buche | B63B 32/73 441/75 |
| 2014/0315455 | A1 * | 10/2014 | Simon Hanska | B63B 32/77 441/75 |
| 2014/0357140 | A1 * | 12/2014 | Falken | B63B 32/70 441/75 |
| 2015/0257767 | A1 * | 9/2015 | Henderson | A61B 17/1327 441/75 |
| 2015/0274265 | A1 * | 10/2015 | Falken | B63B 32/73 441/75 |
| 2019/0106839 | A1 | 4/2019 | Norrie et al. | |
| 2020/0269958 | A1 * | 8/2020 | West | B63B 34/60 |

OTHER PUBLICATIONS

U.S. Receiving Office of WIPO, International Search Report and Written Opinion regarding PCT Patent Application No. PCT/US2020/019998, dated Jun. 10, 2020, 10 pages.

The International Bureau of WIPO, International Preliminary Report on Patentability regarding PCT Patent Application No. PCT/US2020/019998, dated Sep. 10, 2021, 9 pages.

U.S. Patent and Trademark Office, Non-Final Office Action regarding U.S. Appl. No. 16/802,498, dated Jun. 11, 2021, 19 pages.

European Patent Office, Extended European Search Report regarding European Patent Application No. 20763479.1, dated Aug. 26, 2022, 7 pages.

* cited by examiner

LEASH ASSEMBLY FOR A SPORTS BOARD

CROSS-REFERENCE TO RELATED APPLICATIONS

This application is a continuation of U.S. patent application Ser. No. 16/802,498 filed Feb. 26, 2020, issued as U.S. Pat. No. 11,273,888 on Mar. 15, 2022, which claims priority from U.S. Provisional Patent Application Ser. No. 62/810,890 filed Feb. 26, 2019. The complete disclosures of each application are hereby incorporated by reference in their entireties for all purposes.

FIELD

This disclosure generally relates to sports boards designed to support a rider during recreation, and in particular to leash assemblies for surfboards, boogie boards, stand-up paddle boards, and the like for tethering the sports board to a user's limb during recreation.

INTRODUCTION

The popularity of recreational and competitive board sports, such as snowboarding, surfing, boogie boarding, and stand up paddle (SUP) boarding has grown substantially in recent years. The continuing success of surfing, in particular, has created a demand for improved and innovative equipment for both the recreational and the competitive surfer.

For example, surfboards may be equipped with a leg rope or leash, which serves to keep the surfboard associated with the user in the event the user becomes separated from the surfboard, either intentionally or unintentionally. Leashes, as now in use, may consist of a length of rope, cord or similar material that is coupled at one end to a part of the surfboard, while the other end of the rope or cord is generally associated with or coupled to or in some way connected with a leg band, traditionally referred to as a cuff, which is secured around one leg of the board user/rider.

The purpose of using a leg rope or leash is to keep the surfboard attached to the ankle of the user/rider, but at the same time provide sufficient slack that the surfboard can be retained at a safe distance from the user/rider. Should the surfer fall whilst, for example, riding a wave, then the surfboard will not be swept away, allowing the surfer to quickly recover the surfboard and either proceed with the board to shore, or return to the take-off zone for further surfing.

SUMMARY

The present disclosure provides cuff assemblies for use in sports board leashes, sports board leashes for use in conjunction with sports boards, and methods for securing the cuff assemblies of such sports boards.

In some examples, the disclosure provides a cuff assembly for a sports board leash, the cuff assembly including a central section that includes a precurved molded insert configured to connect to a cord of the sports board leash; a first wing attached to a first side of the central section; and a second wing attached to a second side of the central section; where the central section, first wing, and second wing have curvilinear upper and lower borders.

In some examples, the disclosure provides a cuff assembly for a sports board leash, the cuff assembly including a central section that includes a unitary molded insert that is precurved to complement a person's ankle, where the molded insert includes a horn that protrudes from an exterior surface of the central section and is configured to connect to a cord of the sports board leash; a first wing attached to a first side of the central section; and a second wing attached to a second side of the central section; where a maximum width of the central section is greater than a maximum width of either the first wing or the second wing, and the first wing and second wing are configured to overlap and fasten to each other to secure the cuff assembly around a person's limb portion.

In some examples, the disclosure provides a sports board leash including a cord having a first end portion and a second end portion; a cuff assembly connected to the first end of first end portion of the cord; and a sports board fastening device connected to the second portion of the cord. The cuff assembly includes a central section that includes a precurved molded insert that is connected to the first end portion of the cord; a first wing attached to a first side of the central section; and a second wing attached to a second side of the central section; where a maximum width of the central section is greater than a maximum width of either the first wing or the second wing, and the first wing and second wing are configured to overlap and fasten to each other to secure the cuff assembly around a person's limb portion.

In some examples, the disclosure provides a method of securing a cuff assembly for a sports board leash, where the cuff assembly includes a central section that includes a precurved molded insert connected to a first end of a cord of the sports board leash; a first wing attached to a first side of the central section; and a second wing attached to a second side of the central section; where a maximum width of the central section is greater than a maximum width of either the first wing or the second wing, and the first wing and second wing are configured to overlap and fasten to each other to secure the cuff assembly around a person's limb portion. The method of securing the cuff assembly includes aligning the central section of the cuff assembly with a user's Achilles tendon; wrapping the first wing around the ankle surface in a first direction; wrapping the second wing around the ankle surface in an opposite direction, so that the second wing overlaps the first wing; and fastening the second wing to the first wing where the wings overlap.

Features, functions, and advantages of the disclosed sports board leashes may be achieved independently in various examples of the present disclosure, or may be combined in yet other examples, further details of which can be seen with reference to the following description and drawings.

BRIEF DESCRIPTION OF THE DRAWINGS

FIG. 8 is a right side elevational view of the illustrative precurved molded insert of

FIG. 6.

DETAILED DESCRIPTION

Various aspects and examples of a leash for a sports board are described below and illustrated in the associated drawings. Unless otherwise specified, a sports board leash in accordance with the present teachings, and/or its various components may, but are not required to, contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed examples. The following description of various examples is merely illustrative in nature and is in no way intended to limit the disclosure, its application, or uses. Additionally, the advantages provided by the examples described below are illustrative in nature and not all examples provide the same advantages or the same degree of advantages.

The sports board leashes of the present disclosure are particularly useful when used in conjunction with surfboards, boogie boards, and/or paddle boards. However, the disclosed board leashes may also be useful as a retention aid for any other sports board, such as snowboards, or even skis, where they may act as a supplement to, or a backup for, conventional bindings. Depending upon the particular application of the board leash, the cuff assembly can be modified to be used over clothing and/or footwear, such as boots.

Figure 1:
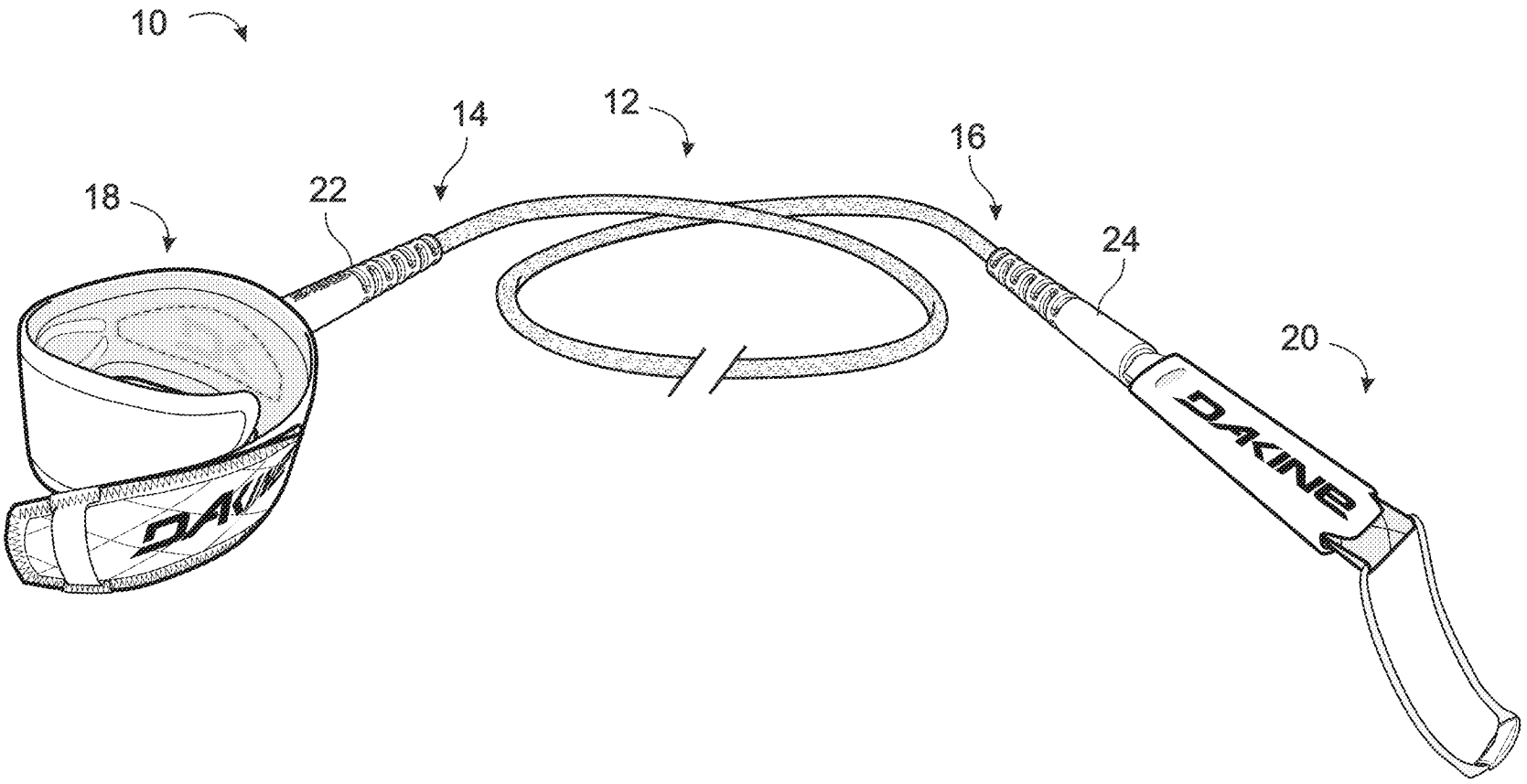
FIG. 1 depicts an illustrative sports board leash in accordance with selected aspects of the present disclosure.

A sports board leash 10 according to the present disclosure is shown in FIG. 1. Board leash 10 can include a cord 12 extending between a first end portion 14 and a second end portion 16 of cord 12. Board leash 10 can further include a cuff assembly 18 connected to first end portion 14, where cuff assembly 18 is configured to be coupled to a person's limb, and a board fastening device 20 that is connected to the second end portion 16, that is configured to be coupled to a sports board.

Cord 12 can be attached to cuff assembly 18 and board fastening device 20 via any suitable connection. In one aspect of the present disclosure, first end portion 14 of cord 12 is connected to cuff assembly 18 via a cord coupling swivel member 22, and second end portion 16 is similarly connected to board fastening device 20 via a cord coupling swivel member 24.

Cuff Assembly

Figure 2:
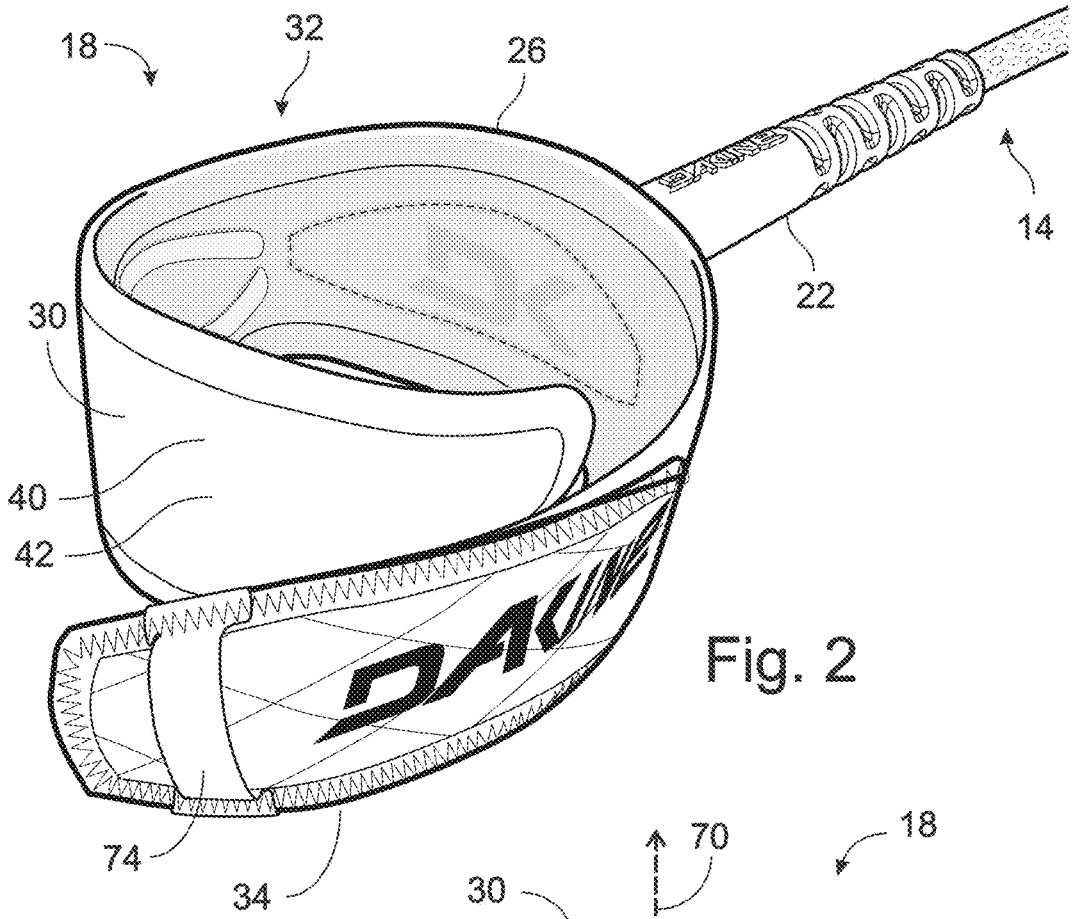
FIG. 2 depicts an illustrative cuff assembly for a sports board leash in accordance with the present disclosure.
Figure 3:
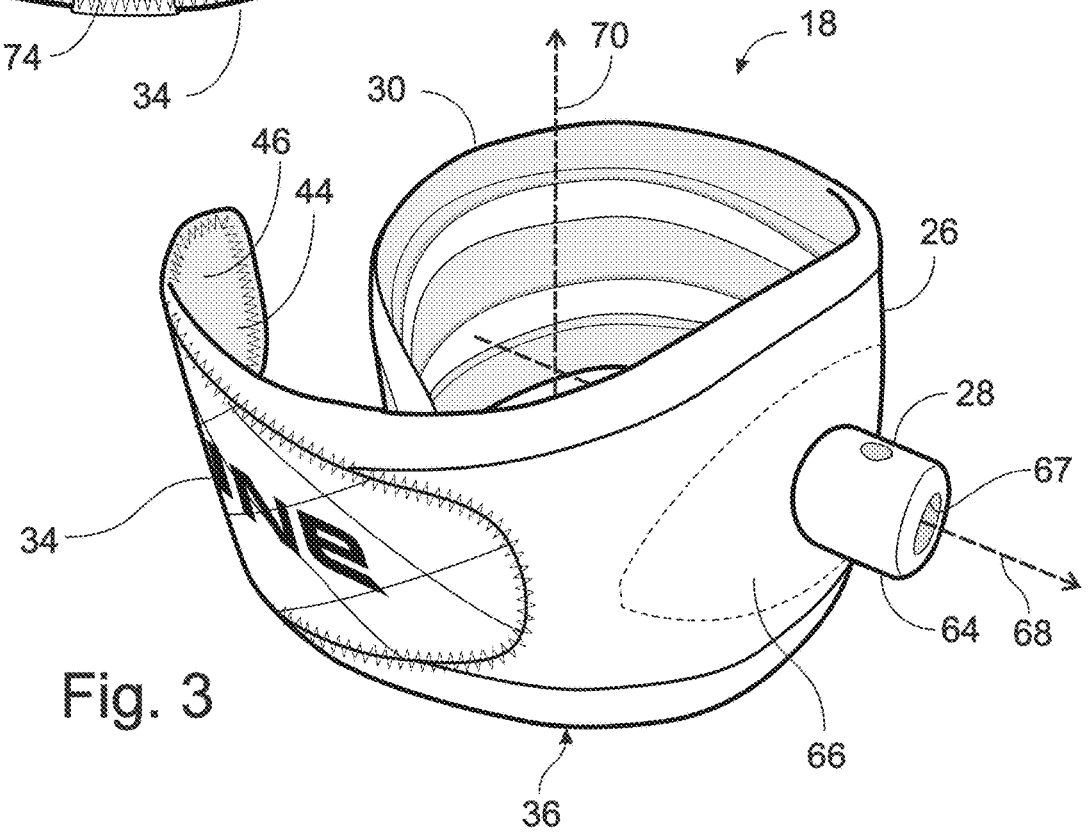
FIG. 3 depicts an alternative view of the illustrative cuff assembly of FIG. 2.

As shown in FIGS. 1-3, cuff assembly 18 can be configured to fit around a portion of a user's limb, in order to secure the sports board leash (and therefore a connected sports board) securely attached to the user. Cuff assembly 18 is configured such that it can be secured to a variety of positions on a given user's limbs, including upper or lower arm, or upper or lower leg. For most board sports, however, cuff assembly 18 can be most advantageously configured to be attached to a user's lower leg portion. That is, cuff assembly 18, as manufactured, incorporates a degree of curl or curvature that is compatible with wrapping around and being secured to a lower leg portion, and in particular, compatible with wrapping and being secured to a user's ankle.

Although cuff assembly 18 is described as configured to be secured to a user's ankle, it should be appreciated that cuff assembly 18 is not specifically intended to be secured around that portion of the ankle that incorporates one or more components of the ankle joint, as the presence of the cuff can in some cases interfere with the mobility of the ankle joint. Rather, cuff assembly 18 is typically configured to be wrapped around and secured to the user's lower leg below the calf yet above the malleoli (the bone prominences on each side of the ankle).

For example, as shown in FIGS. 2-3, cuff assembly 18 can include a central cuff section 26 that includes a precurved molded insert 28. Cuff assembly 18 further includes a first wing 30 that is attached to a first side 32 of central section 26, and a second wing 34 attached to a second side 36 of central section 26. First wing 30 and second wing 34 are configured to be overlapped and fastened to each other in order to secure cuff assembly 18 around a person's limb portion. More specifically, first wing 30 and second wing 34 of cuff assembly 18 can be configured to fasten to each other by first wrapping first wing 30 around the user's limb and then overlapping first wing 30 with second wing 34, and cuff assembly typically includes a closure mechanism 38.

Any closure mechanism that can comfortably and securely retain cuff assembly 18 to a user's limb during the normal use of the associated sports board can be a suitable closure for the purposes of the disclosed cuff assembly. There may be advantages, however, in employing a relatively soft, waterproof, and highly secure hook-and-loop closure to secure cuff assembly 18. Where a hook-and-loop closure is employed as closure 38, a first component 40 of the hook-and-loop closure can be disposed on an outer surface 42 of first wing 30, and the complementary second component 44 of the hook-and-loop closure can be disposed on an inner surface 46 of second wing 34. The use of a hook-and-loop closure for cuff assembly 18 may be made more user-friendly and easier to engage where first wing 30 is one or both of wider than second wing 34, and longer than second wing 34, preferably both wider and longer to provide a larger "target" for securing second wing 34, as is more clearly shown in FIGS. 4-5.

Cuff assembly 18 can be precurved, that is a curve can be imparted to the materials making up cuff assembly 18 so that it exhibits a permanent curvature during manufacture, and so is therefore easier to fasten to a limb portion of a user than a cuff with no permanent precurved structure. The precurvature of cuff assembly 18 can be created during manufacture by one or more methods. For example, portions of the cuff assembly, and in particular first wing 30 and second wing 34 can incorporate a plurality of fabric layers that can be manufactured together such that each wing has a memorized degree of curvature. Alternatively, or in addition, cuff assembly 18 can be precurved due in part to an application of a curved heat press to one or more components of cuff assembly 18, or the cuff assembly as a whole during manufacture of the cuff assembly.

The curvature imparted to cuff assembly 18 can help assist the user to fasten the cuff assembly to a limb portion. This may be particularly true where a component of the cuff assembly is both curved and stiffened, a stiffened cuff component is one that resists at least somewhat being flexed. Typically, central section 26 of cuff assembly 18 is stiffer, and more resistant to flexing, than either first wing 30 or second wing 34. Alternatively, or in addition, second wing 34 can be stiffer, and more resistant to flexing, than first wing 30.

The precurve of central section 26 is reinforced and maintained by molded insert 28. The curve of molded insert 28 is shaped and sized so as to be complementary to the rear surface of a user's ankle. In particular, center section 26 of cuff assembly is configured to be placed against the rear surface of the user's ankle, adjacent to the user's Achilles tendon, and then secured in that position. In order to enhance the comfort and security of surf board leash 10, cuff assembly 18 is therefore configured so that a maximum width 48 of central section 26 is greater than a maximum width 50 of first wing 30 or a maximum width 52 of second wing 34, placing greater support at and around the user's Achilles tendon. This may be particularly advantageous as central section 26 serves as the attachment point of cord 12 of sports board leash 10, and may therefore be the recipient of stresses and shocks during use.

In another aspect of the disclosed cuff assembly, the middle portions of first wing 30 and second wing 34 can incorporate the region of maximum width for each wing, and each wing may then taper in width at both ends. As a result, cuff assembly 18 may exhibit an overall profile that exhibits several compound curves, that is, both an upper edge 54 and a lower edge 56 may be curvilinear, or consisting of a curved line or lines, which can provide an attractive appearance while the cuff regions exhibiting increased width can further provide additional support to the cuff assembly, helping to comfortably distribute stress and shock more evenly around the cuff for a more comfortable and effective anatomical fit.

in another aspect of the disclosed cuff assembly 18, an inner surface 58 of first wing 30 can be functionalized by the presence of an applied pattern 60 of a frictional material 62 that serves to reduce slipping when cuff assembly 18 is wet. As exemplified in FIG. 5, applied pattern 60 can include simple arcuate forms, or applied pattern 60 can include a repeating pattern of frictional pads across some or all of inner surface 58. A variety of frictional materials can be suitable for forming applied pattern 60, however the use of silicone polymer in particular can provide enhanced grip when wet while still exhibiting sufficient resilience to provide comfort.

Precurved molded insert 28 typically is typically injection molded as a unitary piece of polymer. Molded insert 28 is typically retained within central section 26 of cuff assembly 18, disposed between component layers of the cuff assembly excepting for a horn portion 64 that projects from an outer surface 66 of central section 26. Typically, molded horn portion 64 can have a height in a range of 30 mm to 50 mm, and a width in a range of 60 mm to 90 mm. Horn portion 64 can be configured to connect to cord 12 of sports board leash 10. More specifically, horn portion 64 can be configured to attach a cord coupling structure such as cord coupling swivel member 22, which secures cuff assembly 18 to cord 12.

Figure 6:
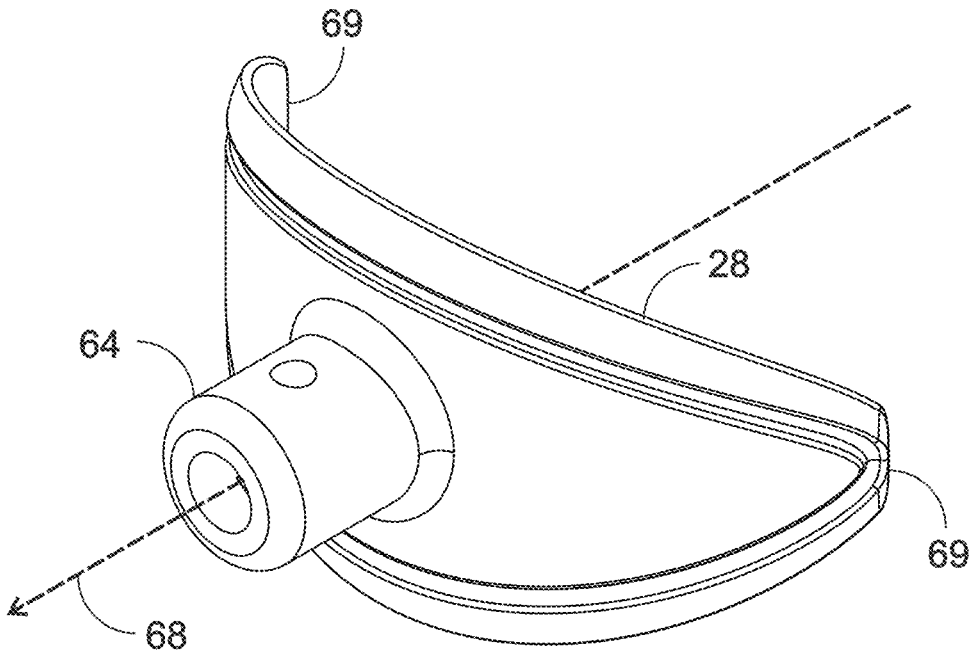
FIG. 6 is a perspective view of an illustrative precurved molded insert for a sports board leash in accordance with the present disclosure.

As shown in FIGS. 3 and 6, molded horn portion 64 defines a hole 67 configured to receiving a cord connection device. Molded horn portion 64 serves to defines a central axis 68 through hole 67 that is coextensive with the direction of cord 12 when attached to molded horn portion 64.

An exemplary molded insert 28 is shown in FIGS. 6-9. Although the precise shape of the outline of molded insert 28 may vary, typically molded insert 28 displays an overall outline that is wider than it is tall, and molded insert 28 is curved to fit comfortably against a surface of a user's limb. The sides 69 of molded insert 28 curve inwardly and around a limb axis 70 that is defined by its alignment with the user's limb where cuff assembly 18 is worn, such that limb axis 70 extends perpendicularly to central axis 68.

Figure 7:
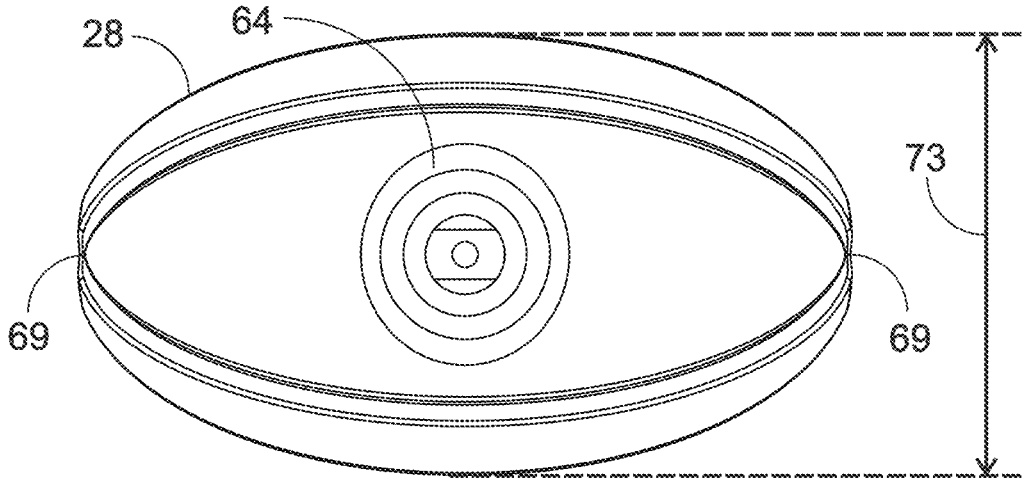
FIG. 7 is a rear elevational view of the illustrative precurved molded insert of FIG. 6.
Figure 8:
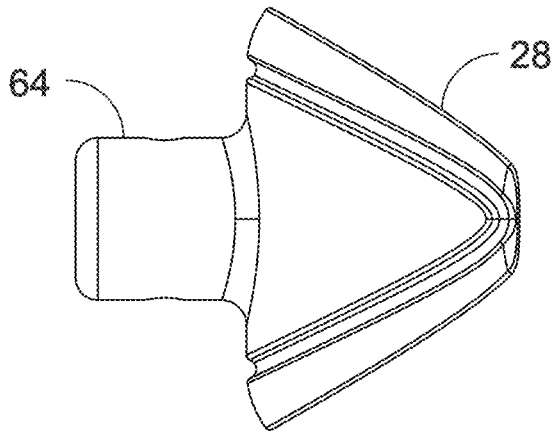
Figure 9:
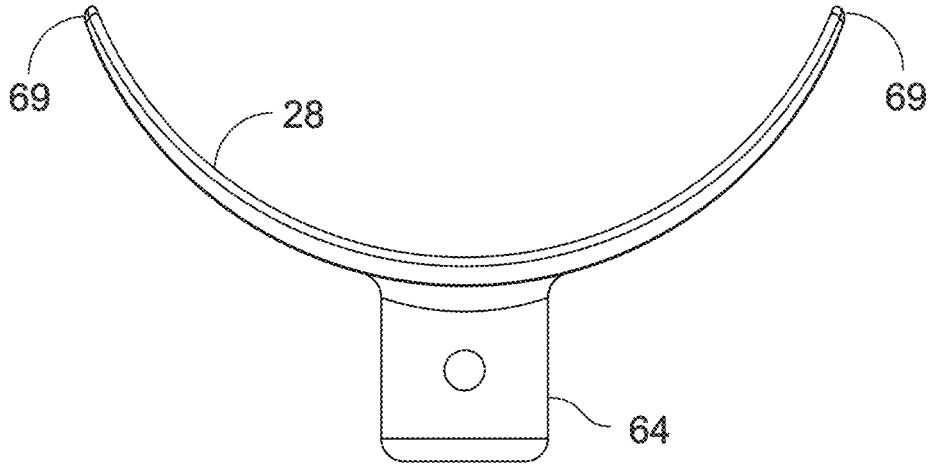
FIG. 9 is a top plan view of the illustrative precurved molded insert of FIG. 6.

Molded insert 28 is wider within the plane defined by cuff assembly 18, than it is tall along a vertical axis, i.e., parallel to limb axis 70. A suitable outline shape for precurved molded insert 28 can include any one of a flattened diamond, a rounded rhombus, an ellipse, an oblate ellipse, or an oval. Due to the shape of molded insert 28, central section 26 of cuff assembly 18 can exhibit an upper edge 71 and a lower edge 72 that convex curves that are shaped to accommodate the outline of the precurved molded insert. In particular, curving upper edge 71 and curving lower edge 72 can be mirror-symmetrical in appearance. Although molded insert 28 is wider than it is tall, a maximum height 73 of molded insert 28 is measured orthogonally to central axis 68, as shown in FIG. 7.

Figure 4:
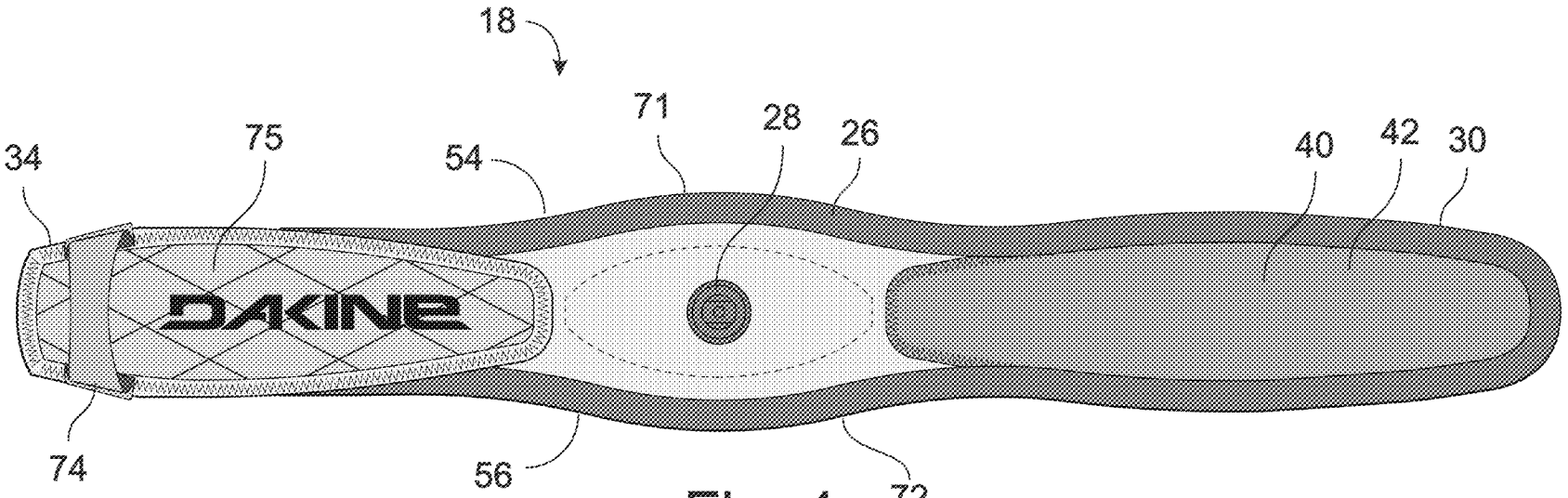
FIG. 4 provides a plan view of the outer surfaces of an illustrative cuff assembly according to the present disclosure, where the cuff assembly is shown in a flat configuration.
Figure 5:
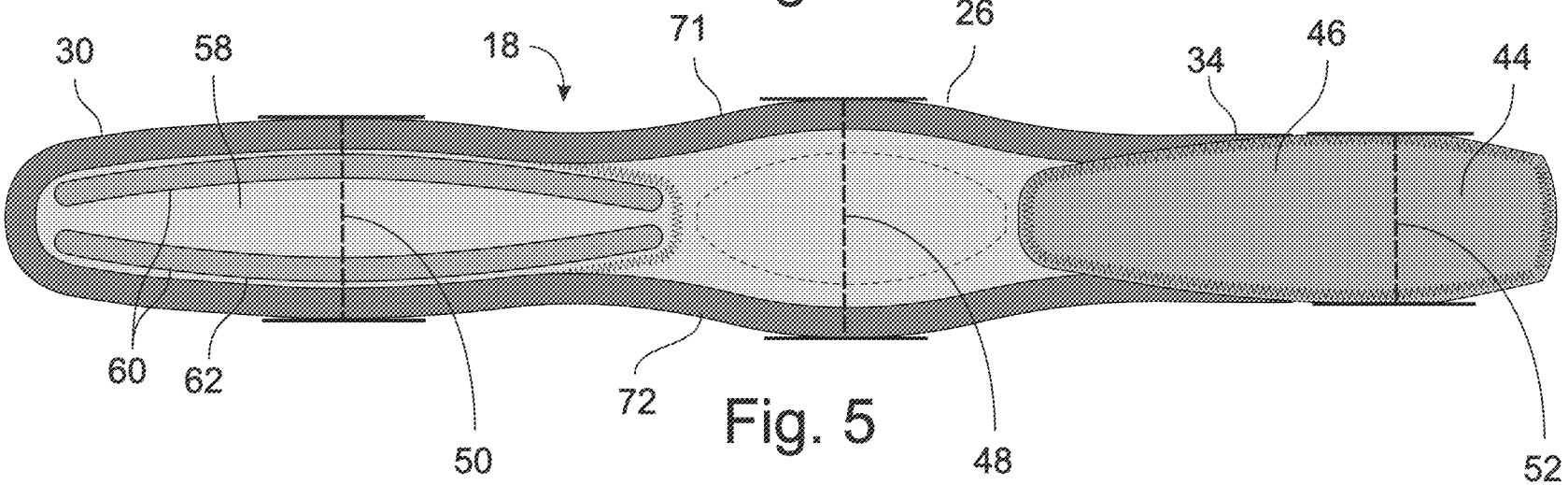
FIG. 5 provides a plan view of the inner surfaces of an illustrative cuff assembly according to the present disclosure, where the cuff assembly is shown in a flat configuration.

The attachment and detachment of cuff assembly 18 to a user's limb may be facilitated by the presence of a pull handle member 74 disposed on outer surface 75 of second wing 34, typically at an end of second wing 34. The pull handle member 74 can have any suitable configuration, but may be either a molded pull handle member or a low profile fabric pull tab or loop, as shown in FIGS. 1, 2, and 4 that does not substantially project beyond the surface of the cuff and is thus less prone to snagging.

Cord

As discussed above, sports board leash 10 can include cord 12 that extends between and connects cuff assembly 18, connected to first end portion 14 of cord 12, and board fastening device 20, connected to second end portion 16 of cord 12.

Although cord 12 typically includes one or more synthetic plastics, the plastics should be selected for appropriate strength, resilience, and stability for use in combination with board sports. Cord 12 should be light, strong, and resistant to the effects of being repeatedly subjected to impact forces such as may be generated when a leashed surfboard is separated from its user/rider. Some elongation under such shocks and impacts may be helpful in absorbing such forces, but cord 12 should be resilient and not necessarily elastic. Cord 12 should be at least substantially resistant to extended exposure to both sunlight and water, and in particular the strength and resilience of cord 12 should not be diminished while wet.

Figure 10:
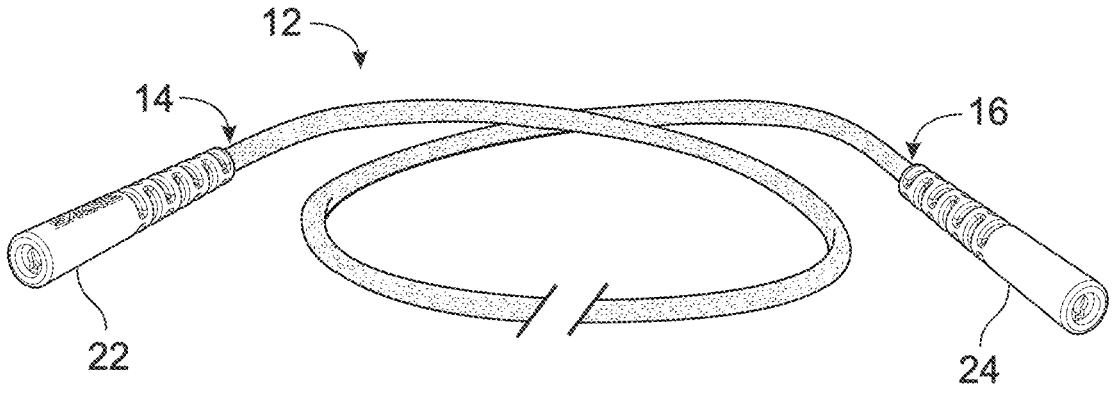
FIG. 10 depicts an illustrative cord of indeterminate length for a sports board leash of the present disclosure, including terminal over-molded swivel members at the first end portion and second end portion of the cord.

Cord 12 includes an outer surface 76, that may be physically configured so as to help minimize drag during use. That is, outer surface 76 can be configured to minimize resistance to movement of cord 12 through water. For example, outer surface 76 may be made smooth, or may incorporate micro-rib structures. It may be particularly advantageous, as shown in FIGS. 10 and 11, for outer surface 76 of cord 12 to incorporate a surface texture that includes a plurality of dimples or recesses 78, where the recesses in outer surface 76 are intended to reduce drag as cord 12 moves through water.

Recesses 78 can be disposed along substantially the entire length of cord 12, and may be distributed unevenly or, more preferably, distributed evenly along cord 12. Recesses 78 may have any of a variety of shapes, which may be the same or different. Typically each of the recesses 78 has a substantially identical shape, which can be circular or ovate. More typically, all recesses 78 have a substantially circular circumference.

Figure 11:
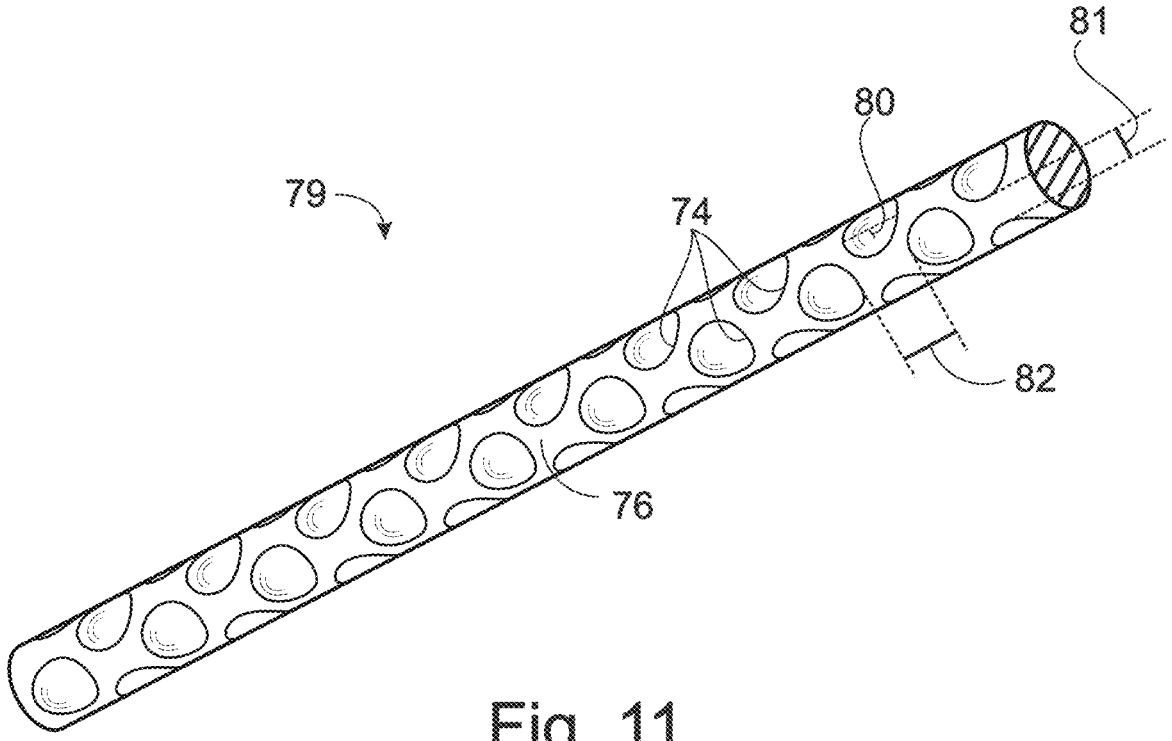
FIG. 11 depicts a representative segment of an illustrative cord for a sports board leash of the present disclosure, including surface recesses.

A representative and illustrative distribution of recesses 78 on cord 12 is shown in greater detail for a short segment 79 of cord 12 in FIG. 11. The pattern of recesses shown in FIG. 11 can represents a portion of a repeating pattern along cord 12, creating translational symmetry along the cord. Each recess 78 can have a depth 80, for example, in a range of 0.20 mm to 0.50 mm. When considering separation around a circumference of cord 12, adjacent recesses 78 can be separated by a separation distance 81 that is in a range of 1.0 mm to 3.5 mm. Alternatively or additionally, recesses 78 that are adjacent when considered along the length of cord 12 can be separated by a distance 82 that is in a range of 4.0 mm to 8.0 mm.

In an alternative aspect of the present disclosure, recesses 78 of cord 12 may define grooves or other geometrical shapes configured to reduce drag of the cord when moving through water.

As shown in FIGS. 1 and 10, cord 12 is typically connected at first end portion 14 to cord coupling swivel member 22, and at second end portion 16 to cord coupling swivel member 24. Swivel member 22 is typically over-molded onto cord 12, and is typically formed so as to be complementary and compatible with horn portion 64 of precurved molded insert 28. Similarly, swivel member 24 is typically over-molded onto cord 12, and is typically formed so as to be complementary to and compatible with attachment to board fastening device 20. The swivel function of each of swivel members 22 and 24 is typically incorporated into the connection between swivel member 22 and cuff assembly 18, and the connection between swivel member 24 and board fastening device 20.

Board Fastening Device

As discussed above, sports board leash 10 can include board fastening device 20 that is connected to second end portion 16 of cord 12 that then extends to and connects cuff assembly 18 board fastening device 20.

Figure 12:
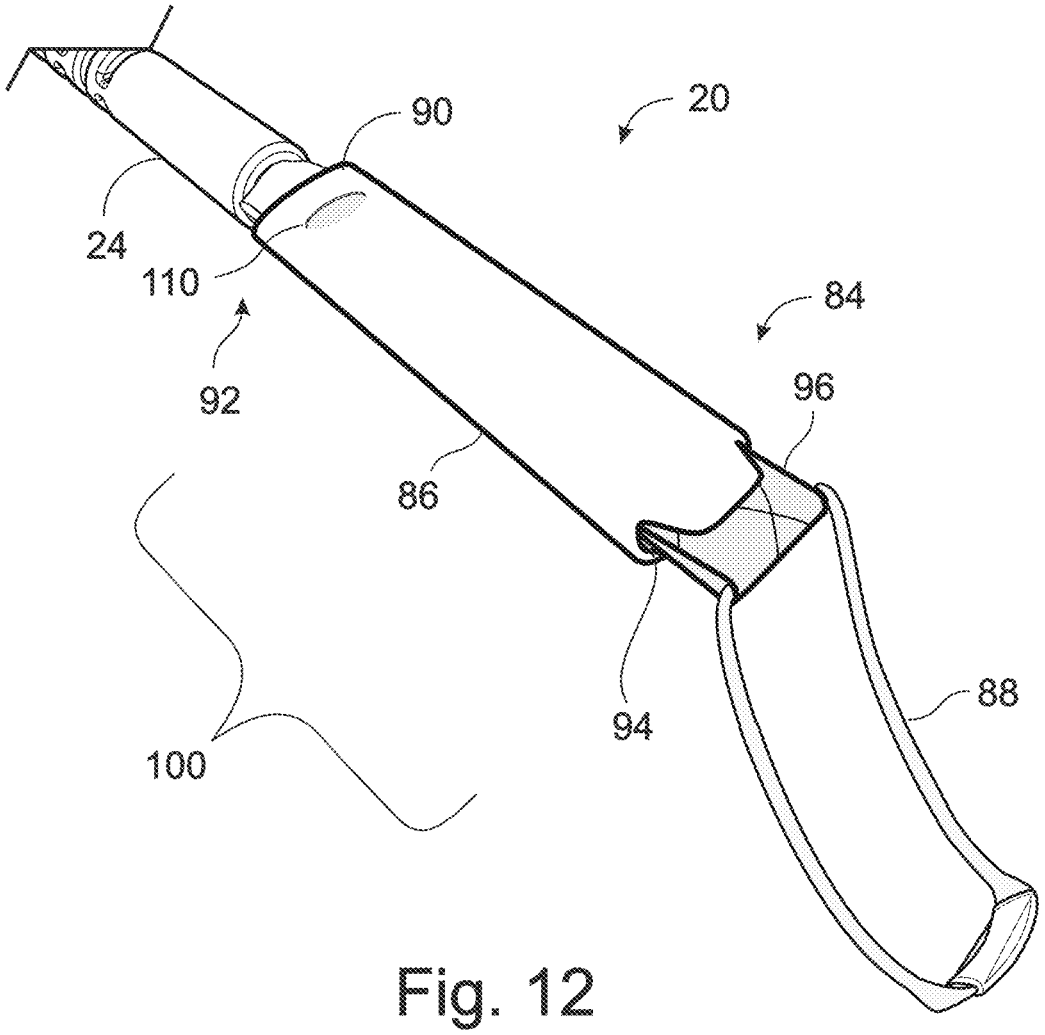
FIG. 12 depicts an illustrative board fastening device for a sports board leash of the present disclosure, including a rail saver in a closed configuration.
Figure 13:
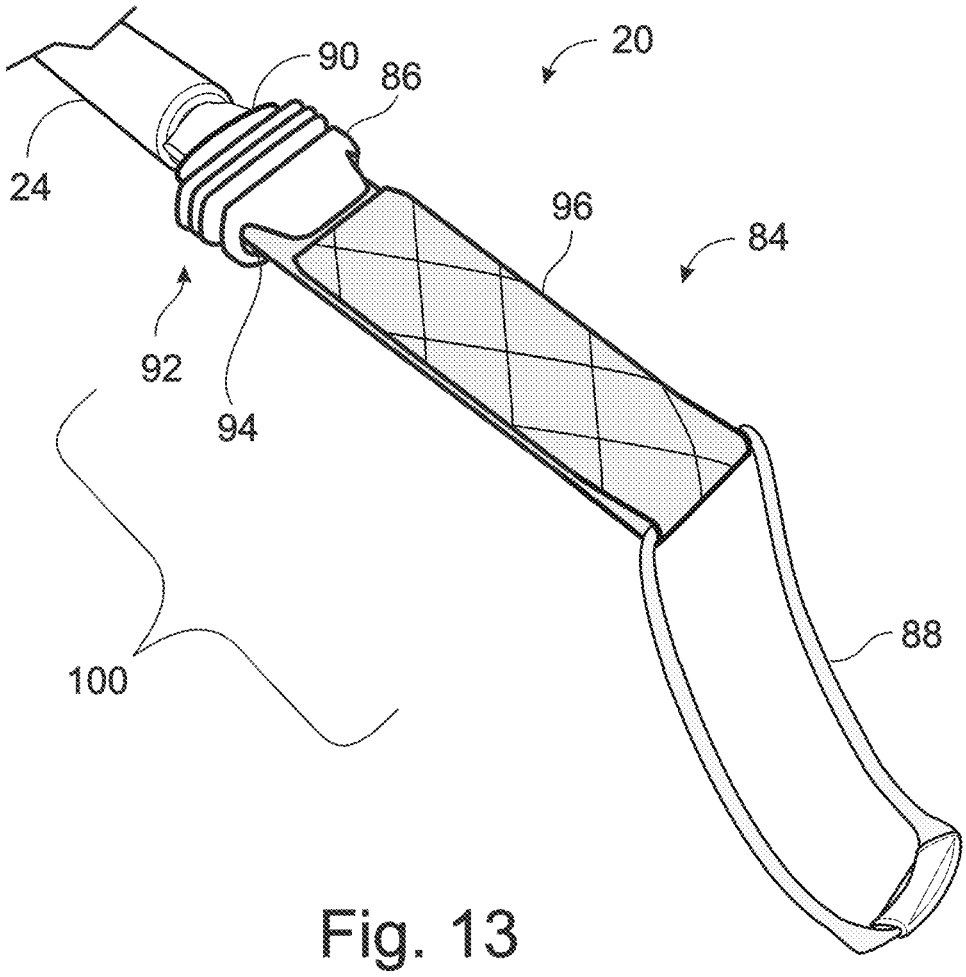
FIG. 13 depicts the illustrative board fastening device of FIG. 12, with the rail saver sleeve retracted to provide access to the rail saver.
Figure 14:
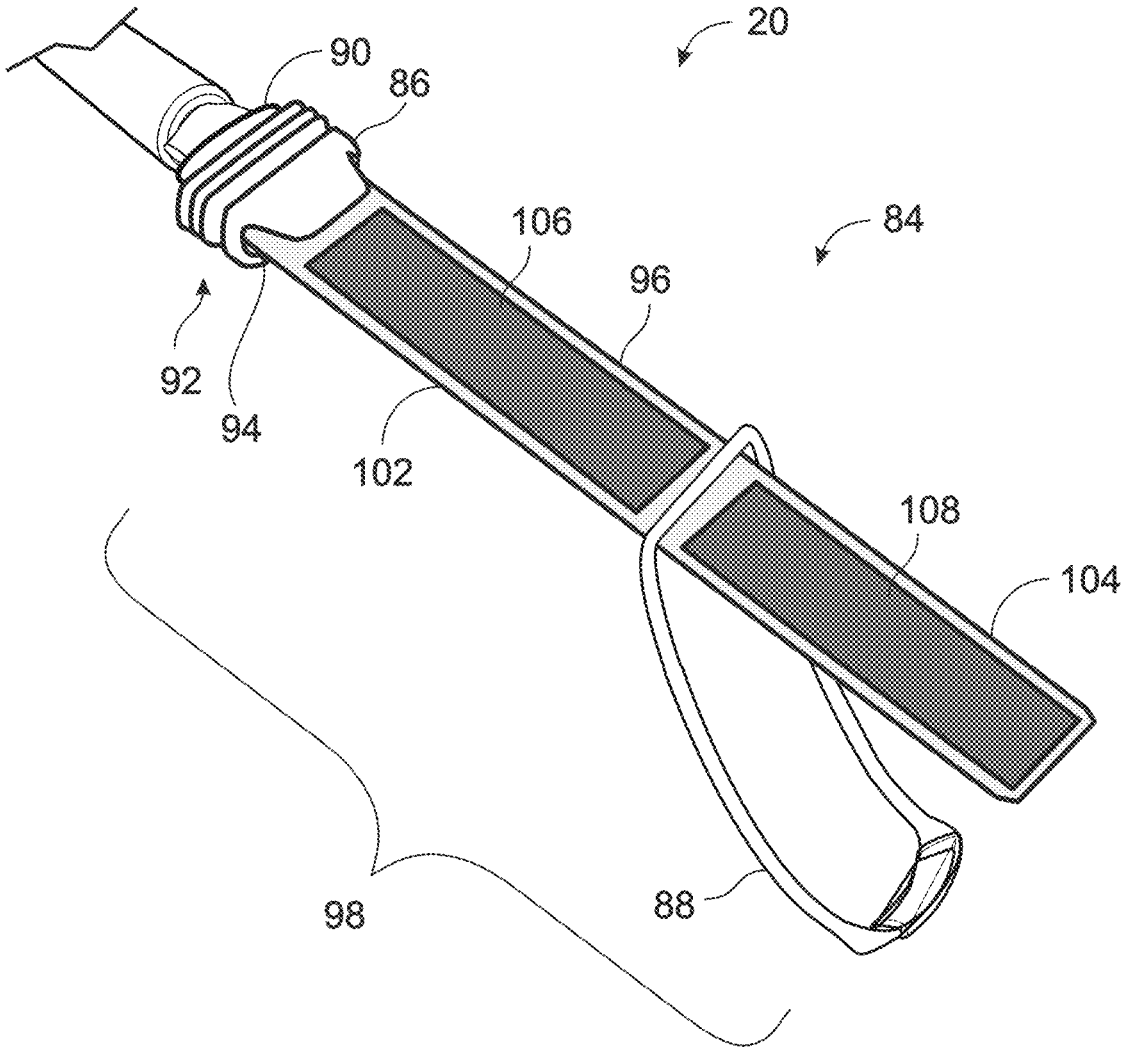
FIG. 14 depicts the illustrative board fastening device of FIG. 12, with the rail saver sleeve retracted and the rail saver in its open configuration.

Board fastening device 20 can be any fastening device suitable for coupling a sports board to cord 12, and thereby to cuff assembly 18, for retaining the sports board with the user/rider that is wearing cuff assembly 18. For example, board fastening device 20 can include a rail saver 84, a sleeve 86 that reversibly covers rail saver 84, and a cord loop 88 that is reversibly retained by rail saver 84, as shown in FIGS. 12-14.

The rails of a surfboard are the "edges" of the board where the deck and the bottom of the board meet. A surfboard's rails run from the tail to the nose of the board, and the particular shape of the rails determines how water flows over them when the board is planning and turning. The particular configuration of a board's rails helps to determine the overall performance characteristics of that surfboard.

Unfortunately, upon the loss of a user/rider, a great deal of force can be applied by a leash cord if it happens to lie across a rail of the board when it is jerked taut. For this reason, most board leashes incorporate some form of a rail saver, which provides a barrier between the cord of the leash and the rails of the surfboard. Generally, the wider and longer the rail saver may be, the greater the area over which the cord's impact can be distributed, and therefore the greater the protection given to the board. However, and at the same time, a large rail saver can also create more drag in the water. Rail savers typically also incorporate one or more features to help ensure the security of the connection to the sports board, in order to prevent inadvertent and unwanted release of the sports board.

Sleeve 86 can be generally tubular in shape, and be disposed so that sleeve 86 substantially encloses rail saver 84. Sleeve 86 can have a fixed end 90 that can be attached adjacent a proximal end 92 of board fastening device 20. The further, or distal, end of sleeve 86 can include an open end 94.

Rail saver 84 can have any suitable construction, but typically incorporates a durable strap 96, such as nylon webbing or similar material, that can have an open configuration 98 and a closed configuration 100. As shown in FIG. 12 strap 96 of illustrative rail saver 84 includes a proximal end portion 102 and a distal end portion 104, where proximal end portion 102 of strap 96 is coupled to cord 12 via cord coupling swivel member 24. When in its open configuration 98, strap 96 can be unfolded with distal end portion 104 free, and cord loop 88 can be readily threaded onto strap 96. Rail saver 84 can then be converted to its closed configuration 100 by folding one or more portions of strap 96 onto itself, and securing the strap in that folded configuration. When in its closed configuration 100, strap 96 securely retains cord loop 88.

For illustrative rail saver 84 of FIGS. 12-14, strap 96 has an open configuration 98 where the strap is unfolded, and can be converted to closed configuration 100 by folding strap 96 to bring distal strap portion 104 into contact with proximal strap portion 102, and securing strap 96 in its closed configuration by a suitable fastening mechanism. For example, proximal strap portion 102 and distal strap portion 104 can be modified by the attachment of a first component 106 and a second component 108 of a hook-and-loop fastening mechanism, respectively such that when folded over, strap 96 securely retains cord loop 88.

When rail saver 84 is in closed configuration 100 it is typically enclosed by tubular sleeve 86, as shown in FIG. 12. Sleeve 86 not only provides additional protection for rail saver 84 during us, but additionally secures cord loop 88 by preventing strap 96 from being unfolded inadvertently. Sleeve 86 typically comprises a flexible and somewhat elastic woven fabric that is resistant to being damaged by exposure to water, and can include one or more drain holes 110 configured to permit water to drain from sleeve 86 so it is not retained therein. Sleeve 86 can have a length approximately the same or slightly shorter than rail saver 84 when in closed configuration 100.

In order to unfold strap 96 when in its closed configuration 100, open end 94 of sleeve 86 can be readily compressed by pleating or folding the fabric of sleeve 86 in order to expose rail saver 84, as shown in FIGS. 13-14. In this way, rail saver 84 can be readily coupled or uncoupled to cord loop 88.

In an advantageous aspect of the board fastening device 20, cord loop 88 can have the form of a loop that fails to include a knot securing the cord. That is, while cord 88 defines a loop structure, the loop is not formed by joining the ends of a cord using a knot. Cord loop 88 is in turn configured to attach to, for example, a leash plug on a sports board, and board fastening device 20 advantageously permits rail saver 84 (and therefore the board leash) to be connected to a sports board with only a single folding operation.

Method of Using the Sports Board Leash

Figure 15:
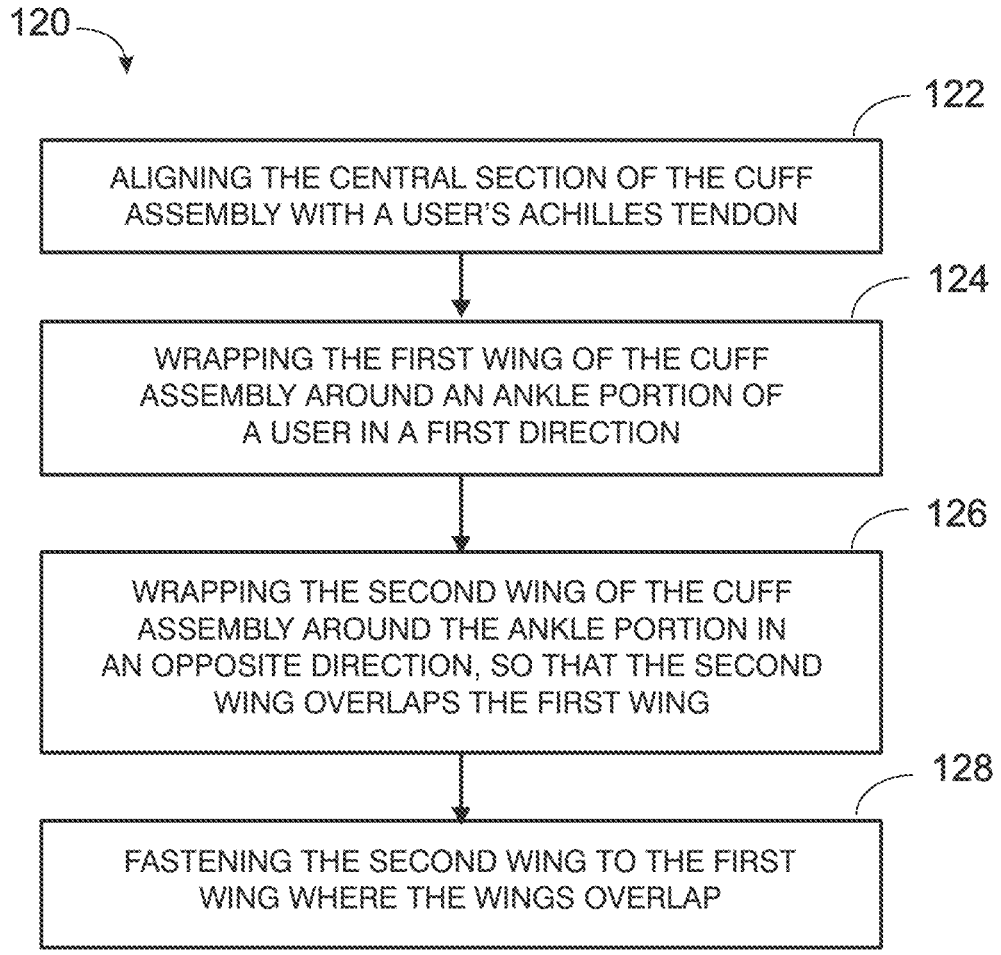
FIG. 15 provides a flowchart setting out an illustrative method of securing a cuff assembly for a sports board leash according to the present disclosure.

The presently disclosed sports board leash lends itself to a method of securing a cuff assembly for a sports board leash, as set out in flowchart 120 of FIG. 15. The method can include aligning the central section of the cuff assembly with a user's Achilles tendon, at step 122 of flowchart 120; wrapping the first wing of the cuff assembly around an ankle portion of a user in a first direction, at step 124 of flowchart 120; wrapping the second wing of the cuff assembly around the ankle portion in an opposite direction, so that the second wing overlaps the first wing, at step 126 of flowchart 120; and fastening the second wing to the first wing where the wings overlap, at step 128 of flowchart 120.

Illustrative Combinations and Additional Examples

This section describes additional aspects and features of leash assemblies for sports boards, as presently disclosed, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A1. A cuff assembly for a sports board leash, comprising:

a central section that includes a precurved molded insert configured to connect to a cord of the sports board leash;

a first wing attached to a first side of the central section; and a second wing attached to a second side of the central section;

wherein the central section, first wing, and second wing have curvilinear upper and lower borders.

A2. The cuff assembly of paragraph A1, wherein the first wing and the second wing are configured to fasten to each other by overlapping the first wing with the second wing, and the first wing is both wider and longer than the second wing.

A3. The cuff assembly of paragraph A1, wherein a maximum width of the central section is greater than a maximum width of either the first wing or the second wing, and the first wing and second wing are configured to overlap and fasten to each other to secure the cuff assembly around a person's limb portion.

A4. The cuff assembly of paragraph A1, wherein the precurved molded insert includes a molded horn that protrudes from an outer surface of the central section and is configured to connect to the cord of the sports board leash.

A5. The cuff assembly of paragraph A4, wherein the molded horn defines a hole for receiving a cord connection device, and defines a central axis through the hole coextensive with a cord direction, the molded insert being precurved around a limb axis that is perpendicular to the defined central axis.

A6. The cuff assembly of paragraph A5, wherein the molded insert has a maximum height measured orthogonally to the central axis A7. The cuff assembly of paragraph A5, wherein each of the first wing and second wing includes plural layers manufactured together such that each wing has a memorized degree of curvature around the limb axis.

A8. The cuff assembly of paragraph A1, wherein the central section is stiffer than either the first wing or the second wing.

A9. The cuff assembly of paragraph A1, wherein the second wing further includes a pull handle member and is stiffer than the first wing.

A10. The cuff assembly of paragraph A1, wherein each of the first wing and the second wing are widest at a middle of the wing, and each wing tapers toward an end of the wing, and narrows where the wing connects to the central section.

A11. The cuff assembly of paragraph A1, wherein the precurved molded insert has an outline that is wider than it is tall.

A12. The cuff assembly of paragraph A11, wherein the precurved molded insert has an outline that is a rounded rhombus, an ellipse, or an oblate ellipse.

A13. The cuff assembly of paragraph A11, wherein an upper edge and a lower edge of the central section define convex curves that are shaped to accommodate the outline of the precurved molded insert.

A14. The cuff assembly of paragraph A13, wherein the curving upper edge and curving lower edge are mirror-symmetrical.

A15. The cuff assembly of paragraph A1, wherein the central section is precurved to complement a rear surface of a person's ankle, and the first wing and second wing are configured to wrap around the person's ankle to secure the cuff assembly to the ankle.

A16. The cuff assembly of paragraph A1, wherein the precurved molded insert includes a molded horn that protrudes from an exterior surface of the central section and is configured to connect to the cord of the sports board leash.

A17. The cuff assembly of paragraph A16, wherein the molded horn is configured to connect to the cord of the sports board leash via a cord coupling structure.

B1. A cuff assembly for a sports board leash, comprising: a central section that includes a unitary molded insert that is precurved to complement a person's ankle, where the molded insert includes a horn that protrudes from an exterior surface of the central section and is configured to connect to a cord of the sports board leash;

a first wing attached to a first side of the central section; and a second wing attached to a second side of the central section;

wherein the first wing and second wing are configured to overlap and fasten to each other to secure the cuff assembly around a person's limb portion.

B2. The cuff assembly of paragraph B1, wherein a maximum width of the central section is greater than a maximum width of either the first wing or the second wing.

B3. The cuff assembly of paragraph B1, wherein both an upper and a lower edge of the cuff assembly are curvilinear.

B4. The cuff assembly of paragraph B1, wherein both the first wind and the second wing are wider in a middle of the wing and tapered at both ends of the wing.

B5. The cuff assembly of paragraph B1 wherein each of the central section, the first wing, and the second wing exhibit a degree of precurving to facilitate securing the cuff assembly around the person's limb portion.

B6. The cuff assembly of paragraph B5, wherein the degree of precurving in the cuff assembly is due in part to an application of a curved heat press to the cuff assembly during manufacture of the cuff assembly.

C1. A sports board leash, comprising:

a cord having a first end portion and a second end portion;

a cuff assembly connected to the first end portion of the cord, the cuff assembly including a central section that includes a precurved molded insert that is connected to the first end portion of the cord;

a first wing attached to a first side of the central section; and a second wing attached to a second side of the central section;

wherein a maximum width of the central section is greater than a maximum width of either the first wing or the second wing, and the first wing and second wing are configured to overlap and fasten to each other to secure the cuff assembly around a person's limb portion; and a sports board fastening device connected to the second end portion of the cord.

C2. The sports board leash of paragraph C1, wherein the cuff assembly is configured to be secured to a person's ankle, and the sports board fastening device is configured to be secured to a surfboard.

D1. A method of securing a cuff assembly for a sports board leash, wherein the cuff assembly includes a central section that includes a precurved molded insert connected to a first end of a cord of the sports board leash;

a first wing attached to a first side of the central section; and a second wing attached to a second side of the central section;

wherein a maximum width of the central section is greater than a maximum width of either the first wing or the second wing, and the first wing and second wing are configured to overlap and fasten to each other to secure the cuff assembly around a person's ankle portion;

comprising: aligning the central section of the cuff assembly with a user's Achilles tendon;

wrapping the first wing around the ankle portion in a first direction;

wrapping the second wing around the ankle portion in an opposite direction, so that the second wing overlaps the first wing; and fastening the second wing to the first wing where the wings overlap.

D2. The method of paragraph D1, wherein the sports board leash further comprises a sports board fastening device connected to a second end of the cord of the sports board leash; further comprising attaching the sports board fastening device to a surfboard.

E1. A sports board leash, comprising:

a cuff assembly connected to a first end portion of a cord, and configured for coupling to a person's limb, and a sports board fastening device connected to a second end portion of the cord, wherein the cord connecting the cuff assembly and the sports board fastening device has a cord surface that includes a plurality of recesses.

E2. The sports board leash of paragraph E1, wherein the plurality of recesses are distributed along substantially the entire length of the cord.

E3. The sports board leash of paragraph E1, wherein the plurality of recesses are evenly distributed along substantially the entire length of the cord E4. The sports board leash of paragraph E1, wherein each of the plurality of recesses is a circular recess.

E5. The sports board leash of paragraph E1, wherein each of the plurality of recesses has a depth in a range of 0.20 mm to 0.50 mm.

E6. The sports board leash of paragraph E1, wherein adjacent recesses in the plurality of recesses in the cord surface are separated by a distance in a range of 1.0 mm to 3.5 mm.

E7. The sports board leash of paragraph E1, wherein adjacent recesses in the plurality of recesses in the cord surface are separated by a distance in a range of 4.0 mm to 8.0 mm.

E8. A surfboard or stand-up paddle board coupled to a sports board leash as recited in any one of paragraphs E1-E7.

F1. A sports board fastening device for attaching a sports board to a sports board leash, the sports board fastening device including a sleeve-covered rail saver.

F2. The sports board fastening device of paragraph F1, wherein the rail saver includes a strap segment having a proximal end portion and a distal end portion; wherein the proximal end portion of the strap segment is configured to be attached to the sports board leash; the strap segment is adapted to have a closed configuration that brings the distal end portion of the strap segment into contact with the proximal end portion of the strap segment; wherein the proximal end portion and the distal end portion of the strap segment are attached to one another by a hook-and-loop fastening mechanism.

F3. The sports board fastening device of paragraph F2, wherein the rail-saver sleeve is attached to and encloses the proximal end portion of the strap segment.

F4. The sports board fastening device of paragraph F2, wherein the rail-saver sleeve has a fixed end and an open end, and is attached to the proximal end portion of the strap segment at the fixed end, such that the rail-saver sleeve can extend over and substantially and reversibly enclose the strap segment when the strap segment is in its closed configuration.

F5. The sports board fastening device of paragraph F2, wherein the rail-saver sleeve includes one or more drain holes.

F6. The sports board fastening device of paragraph F2, wherein the rail-saver sleeve includes a stretch woven fabric.

F7. The sports board fastening device of paragraph F2, wherein the rail-saver sleeve has a length that is approximately the same as a length of the strap segment when in its folded configuration.

F8. The sports board fastening device of paragraph F2, wherein the sports board leash includes a cuff assembly connected to a first end portion of a cord, where the cuff assembly is configured to be coupled to a person's limb; and the proximal end portion of the strap segment is configured to be attached to a second end portion of the cord of the sports board leash.

F9. The sports board fastening device of paragraph F2, wherein when the strap segment is in its unfolded configuration the strap segment can be threaded through a cord loop that can then be securely retained by folding the strap segment into its closed configuration and enclosing the strap segment by the rail-saver sleeve, such that the cord loop can be fastened to a leash plug on a sports board to attach the sports board to the sports board leash.

F10. The sports board fastening device of paragraph F9, wherein the sports board fastening device can be released from an attached sports board by compressing the rail-saver sleeve around the proximal end portion of the strap segment, and opening the strap segment to release the cord loop.

G1. A cuff assembly for a sports board leash, comprising:

a central section that includes a precurved molded insert configured to connect to a cord of the sports board leash;

a first wing attached to a first side of the central section; and a second wing attached to a second side of the central section;

wherein a maximum width of the central section is greater than a maximum width of either the first wing or the second wing, and the first wing and second wing are configured to overlap and fasten to each other to secure the cuff assembly around a person's limb portion.

G2. The cuff assembly of paragraph G1, wherein the first wing and the second wing are configured to fasten to each other by overlapping the first wing with the second wing, and the first wing is both wider and longer than the second wing.

G3. The cuff assembly of paragraph G2, wherein an inner surface of the first wing includes an applied pattern of a frictional material.

G4. The cuff assembly of paragraph G3, wherein the applied pattern of the frictional material includes a silicone polymer.

G5. The cuff assembly of paragraph G2, wherein the first wing and second wing are configured to overlap and fasten to each other using a hook-and-loop closure.

G6. The cuff assembly of paragraph G1, wherein each of the first wing and the second wing are widest at a middle of the wing, and each wing tapers toward an end of the wing, and narrows where the wing connects to the central section.

G7. The cuff assembly of paragraph G1, wherein the precurved molded insert has an outline that is wider than it is tall.

G8. The cuff assembly of paragraph G7, wherein the precurved molded insert has an outline that is a rounded rhombus, an ellipse, or an oblate ellipse.

G9. The cuff assembly of paragraph G7, wherein an upper edge and a lower edge of the central section define convex curves that are shaped to accommodate the outline of the precurved molded insert.

G10. The cuff assembly of paragraph G9, wherein the curving upper edge and curving lower edge are mirror-symmetrical.

G11. The cuff assembly of paragraph G1, wherein the central section is precurved to complement a rear surface of a person's ankle, and the first wing and second wing are configured to wrap around the person's ankle to secure the cuff assembly to the ankle.

G12. The cuff assembly of paragraph G1, wherein the precurved molded insert includes a molded horn that protrudes from an exterior surface of the central section and is configured to connect to the cord of the sports board leash.

G13. The cuff assembly of paragraph G12, wherein the molded horn is configured to connect to the cord of the sports board leash via a cord coupling structure.

H1. A cuff assembly for a sports board leash, comprising:

a central section that includes a unitary molded insert that is precurved to complement a person's ankle, where the molded insert includes a horn that protrudes from an exterior surface of the central section and is configured to connect to a cord of the sports board leash;

a first wing attached to a first side of the central section; and a second wing attached to a second side of the central section;

wherein a maximum width of the central section is greater than a maximum width of either the first wing or the second wing, and the first wing and second wing are configured to overlap and fasten to each other to secure the cuff assembly around a person's limb portion.

H2. The cuff assembly of paragraph H1, wherein both an upper and a lower edge of the cuff assembly are curvilinear.

H3. The cuff assembly of paragraph H2, wherein both the first wind and the second wing are wider in a middle of the wing and tapered at both ends of the wing.

Advantages, Features, and Benefits

The different examples of sports board leash assemblies described herein provide numerous advantages over known solutions for retaining sports boards. For example, described leash assembly examples may provide improved comfort and/or fit around a user's limb; and/or may exhibit reduced fluidic drag; and/or may be more securely fastened to a board, and may be less likely to cause harmful wear or damage to a board in turbulent conditions.

Conclusion

The disclosure set forth above may encompass multiple distinct examples with independent utility. Although each of these has been disclosed in its preferred form(s), the specific examples thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A sports board leash, comprising:

a cuff assembly connected to a first end portion of a cord, and configured for coupling to a person's limb; and a sports board fastening device connected to a second end portion of the cord;

wherein the cord connecting the cuff assembly and the sports board fastening device has a cord surface that includes a plurality of recesses, the plurality of recesses being distributed along substantially the entire length of the cord.

2. The sports board leash of claim 1, wherein the plurality of recesses are evenly distributed along substantially the entire length of the cord.

3. The sports board leash of claim 1, wherein each of the plurality of recesses is a circular recess.

4. The sports board leash of claim 1, wherein each of the plurality of recesses has a depth in a range of 0.20 mm to 0.50 mm.

5. The sports board leash of claim 1, wherein adjacent recesses in the plurality of recesses in the cord surface are separated by a distance in a range of 1.0 mm to 3.5 mm.

6. The sports board leash of claim 1, wherein adjacent recesses in the plurality of recesses in the cord surface are separated by a distance in a range of 4.0 mm to 8.0 mm.

7. The sports board leash of claim 1, wherein the recesses define geometrical shapes configured to reduce drag of the cord when moving through water.

8. A sports board assembly, comprising:

a sports board;

a cuff assembly configured for coupling to a person's limb;

a cord having a first end portion connected to the cuff assembly, and a second end portion fastened to the sport board, the cord having a cord surface that includes a plurality of recesses;

wherein the plurality of recesses are evenly distributed along substantially the entire length of the cord.

9. The sports board assembly of claim 8, wherein each of the plurality of recesses is a circular recess.

10. The sports board assembly of claim 8, wherein the plurality of recesses are configured to reduce drag of the cord through water.

11. The sports board assembly of claim 8, wherein the cuff assembly includes:

a central section that includes a precurved molded insert connected to the cord;

a first wing attached to a first side of the central section; and a second wing attached to a second side of the central section.

12. The sports board assembly of claim 11, wherein an inner surface of the first wing includes an applied pattern of a frictional material.

13. The sports board assembly of claim 12, wherein the applied pattern of the frictional material includes a silicone polymer.

14. The sports board assembly of claim 11, wherein the first wing and second wing are configured to overlap and fasten to each other using a hook-and-loop closure.

15. The sports board assembly of claim 11, wherein the precurved molded insert includes a molded horn that protrudes from an exterior surface of the central section and is configured to connect to the cord via a cord coupling structure.

16. The sports board assembly of claim 8, further including a first swivel member over-molded onto the first end portion of the cord and connecting the cord to the cuff assembly, and a second swivel member over-molded onto the second end portion of the cord and connecting the cord to a sport board fastening device.

17. The sports board assembly of claim 8, further including a sleeve-covered rail saver connecting the second end portion of the cord to the sport board.

18. A method of coupling a sports board to a person's limb, comprising:

overlapping first and second wing portions of a cuff assembly to secure the cuff assembly around the person's limb;

connecting a first cord coupling swivel member on a first end portion of a cord to a molded horn portion of the cuff assembly, the cord having a cord surface that includes a plurality of recesses, wherein the plurality of recesses are distributed along substantially the entire length of the cord;

connecting a second cord coupling swivel member on a second end portion of the cord to a board fastening device; and fastening the board fastening device to a sports board.

* * * * *